US007438542B2

(12) United States Patent
Baxter, Jr. et al.

(10) Patent No.: US 7,438,542 B2
(45) Date of Patent: Oct. 21, 2008

(54) FLUID PUMP ASSEMBLY

(75) Inventors: Ralph W. Baxter, Jr., Fort Wayne, IN (US); Randy Sommer, Monroeville, IN (US); Stephen Garlick, Grand Rapids, OH (US)

(73) Assignee: Dana Automotive Systems Group, LLC., Toledo, OH (US)

( * ) Notice: Subject to any disclaimer, the term of this patent is extended or adjusted under 35 U.S.C. 154(b) by 305 days.

(21) Appl. No.: 11/305,155

(22) Filed: Dec. 19, 2005

(65) Prior Publication Data

US 2007/0140886 A1 Jun. 21, 2007

(51) Int. Cl.
*F01C 19/08* (2006.01)
*F04B 49/00* (2006.01)

(52) U.S. Cl. ..... 418/131; 418/171; 418/196; 417/283; 417/310

(58) Field of Classification Search ..... 418/196, 418/171, 58, 61.2, 61.3, 131, 132, 2, 40, 418/41; 417/283, 310
See application file for complete search history.

(56) References Cited

U.S. PATENT DOCUMENTS

| | | | | |
|---|---|---|---|---|
| 1,486,836 | A | | 3/1924 | Hill |
| 2,380,783 | A | | 7/1945 | Painter |
| 2,405,061 | A | | 7/1946 | Shaw |
| 3,034,446 | A | | 5/1962 | Brundage |
| 4,014,630 | A | * | 3/1977 | Drutchas ..... 417/283 |
| RE29,456 | E | * | 10/1977 | Drutchas et al. ..... 417/283 |
| 4,253,803 | A | * | 3/1981 | Wormmeester et al. ..... 417/283 |
| 4,398,871 | A | * | 8/1983 | Grabb ..... 417/283 |
| 4,408,963 | A | * | 10/1983 | Drutchas ..... 417/283 |
| 4,422,834 | A | * | 12/1983 | Drutchas et al. ..... 417/283 |
| 4,457,677 | A | | 7/1984 | Todd |
| 4,540,347 | A | | 9/1985 | Child |
| 4,596,519 | A | * | 6/1986 | Tuckey ..... 418/171 |
| 5,017,101 | A | | 5/1991 | White |
| 5,085,187 | A | | 2/1992 | Black |
| 6,676,394 | B2 | | 1/2004 | Bodzak |
| 6,688,851 | B2 | | 2/2004 | Phelan et al. |
| 6,688,866 | B2 | | 2/2004 | Lambert et al. |

* cited by examiner

*Primary Examiner*—Thomas Denion
*Assistant Examiner*—Mary A Davis
(74) *Attorney, Agent, or Firm*—Berenato, White & Stavish

(57) ABSTRACT

A fluid pump assembly comprises a pump housing and a fluid pump disposed within the pump housing. The fluid pump has axially opposite first and second side faces and includes cooperating impeller and rotor members. The fluid pump assembly further comprises inlet and outlet ports disposed adjacent to the first side face, a pressure chamber formed within the pump housing adjacent to the second side face, and an end plate disposed within the pressure chamber and movable relative to the pump between a first position and a second position. The end plate has axially opposite inner and outer end surfaces oriented so that the inner end surface faces the fluid pump, while the outer end surface faces away from the pump. An area of the outer end surface of the end plate is greater than the area of the inner end surface thereof.

16 Claims, 9 Drawing Sheets

FLUID PUMP ASSEMBLY

BACKGROUND OF THE INVENTION

1. Field of the Invention

The present invention relates to fluid pump assemblies in general, and more particularly, to positive displacement fluid pump assemblies.

2. Description of the Prior Art

In conventional integrated pressurized fluid systems the fluid pressure is normally generated by positive displacement pumps, such as gerotor pumps, gear pumps, etc. The gerotor hydraulic pumps are becoming more and more commonplace. The gerotor pumps could be found in many industrial applications such as motor vehicles, robots and mechanized transportation equipment. The hydraulic gerotor pumps are generally preferred in applications associated with vehicular torque couplings, including limited slip differentials. Gerotor pumps are sometimes built into the differential mechanism and housed within the differential case housing. With these increasing numbers of applications comes an ever increasing need for application specific designs, designs including disengageable drives. As gerotor pumps are high torque devices, disengageable drives mean expensive clutches and/or restrictions for engagement. Present attempts to remedy these characteristics, such as multi-pack clutches, external recirculation valves or one-way drive mechanisms, are not efficient in either cost or practicality.

Therefore, the need exists to overcome these shortcomings of the prior art by providing a more efficient and cost-effective selectively operated positive displacement fluid pump assembly.

SUMMARY OF THE INVENTION

The present invention provides a fluid pump assembly for use in a pressurized fluid system. The fluid pump assembly of the present invention comprises a pump housing and a fluid pump disposed within the pump housing. The fluid pump has axially opposite first and second side faces and includes an impeller member and a rotor member cooperating with the impeller member and disposed substantially therewithin for rotation about a central axis. The fluid pump assembly further comprises inlet and outlet ports disposed adjacent to the first side face of the fluid pump, a pressure chamber formed within the pump housing adjacent to the second side face of the fluid pump, and an end plate disposed within the pressure chamber and movable relative to the pump between a first position and a second position. The end plate has axially opposite inner and outer end surfaces oriented so that the inner end surface faces the fluid pump, while the outer end surface faces away from the pump. An area of the outer end surface of the end plate is greater than the area of the inner end surface thereof.

The fluid pump assembly in accordance with the present invention provides a selectively operable fluid pump assembly providing a variable pressure fluid for a pressurized fluid system and capable of selectively deactivating the pump assembly and operated with greatly increased efficiency.

BRIEF DESCRIPTION OF THE DRAWINGS

Objects and advantages of the invention will become apparent from a study of the following specification when viewed in light of the accompanying drawings, wherein.

DESCRIPTION OF PREFERRED EMBODIMENT

Figure 1:
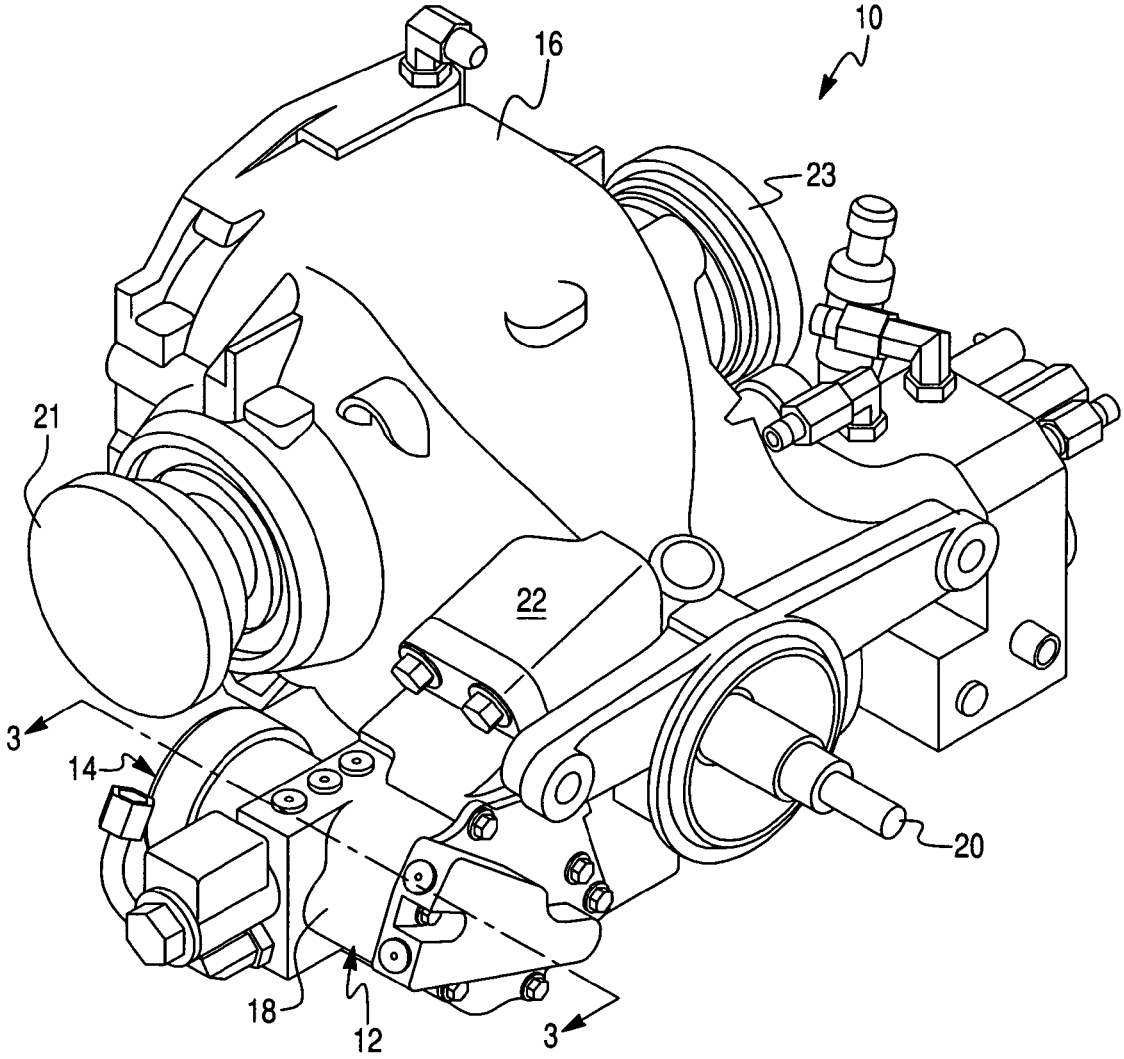
FIG. 1 is a perspective view of a torque coupling assembly according to the preferred embodiment of the present invention.

The preferred embodiment of the present invention will now be described with the reference to accompanying drawings.

For purposes of the following description, certain terminology is used in the following description for convenience only and is not limiting. The words such as "right" and "left", and "inner" and "outer" designate directions in the drawings to which reference is made. The words "smaller" and "larger" refer to relative size of elements of the apparatus of the present invention and designated portions thereof. The terminology includes the words specifically mentioned above, derivatives thereof and words of similar import. Additionally, the word "a," as used in the claims, means "at least one."

Figure 2:
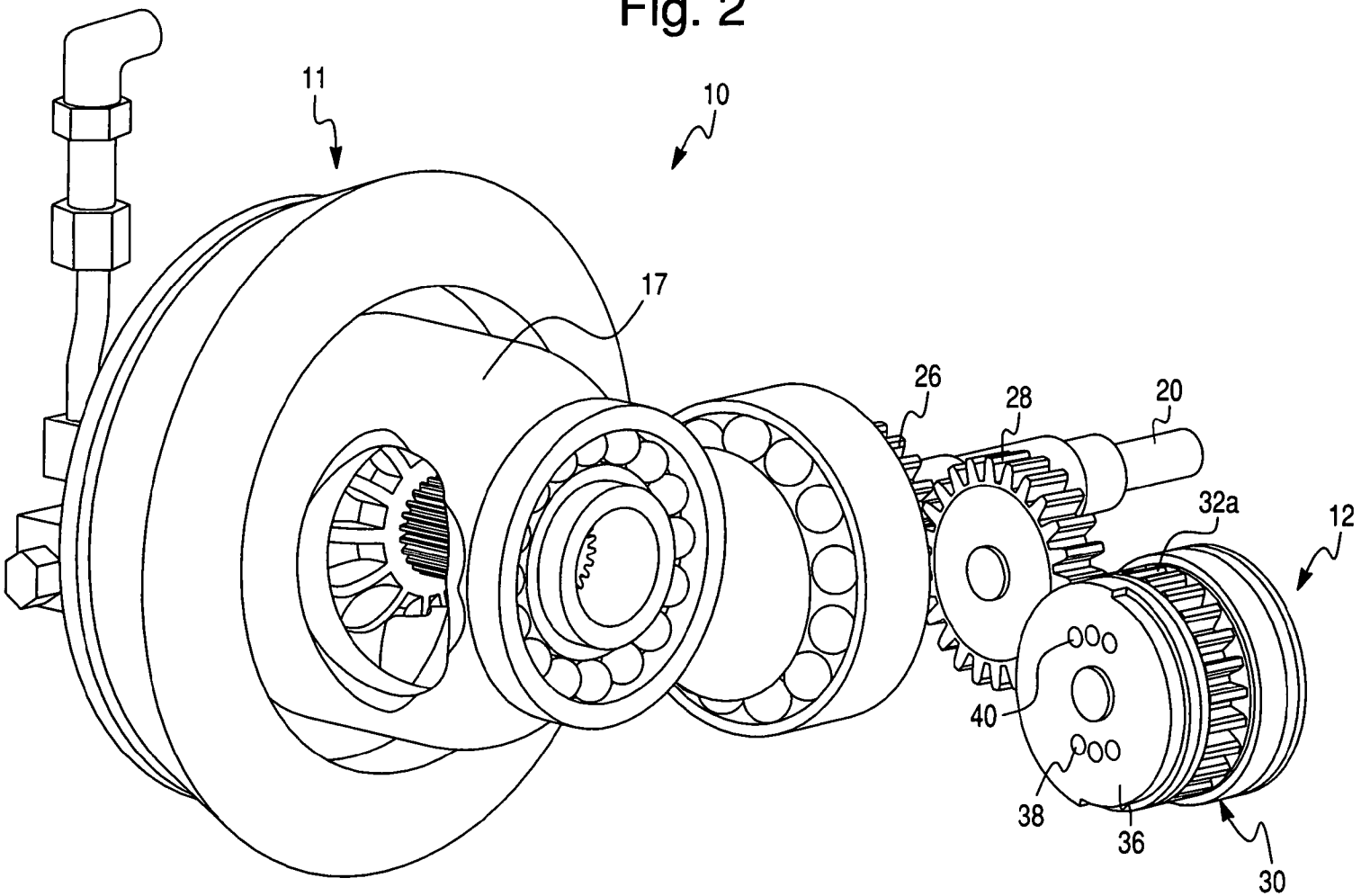
FIG. 2 is a perspective view of a drive train of a fluid pump assembly according to the preferred embodiment of the present invention.
Figure 3A:
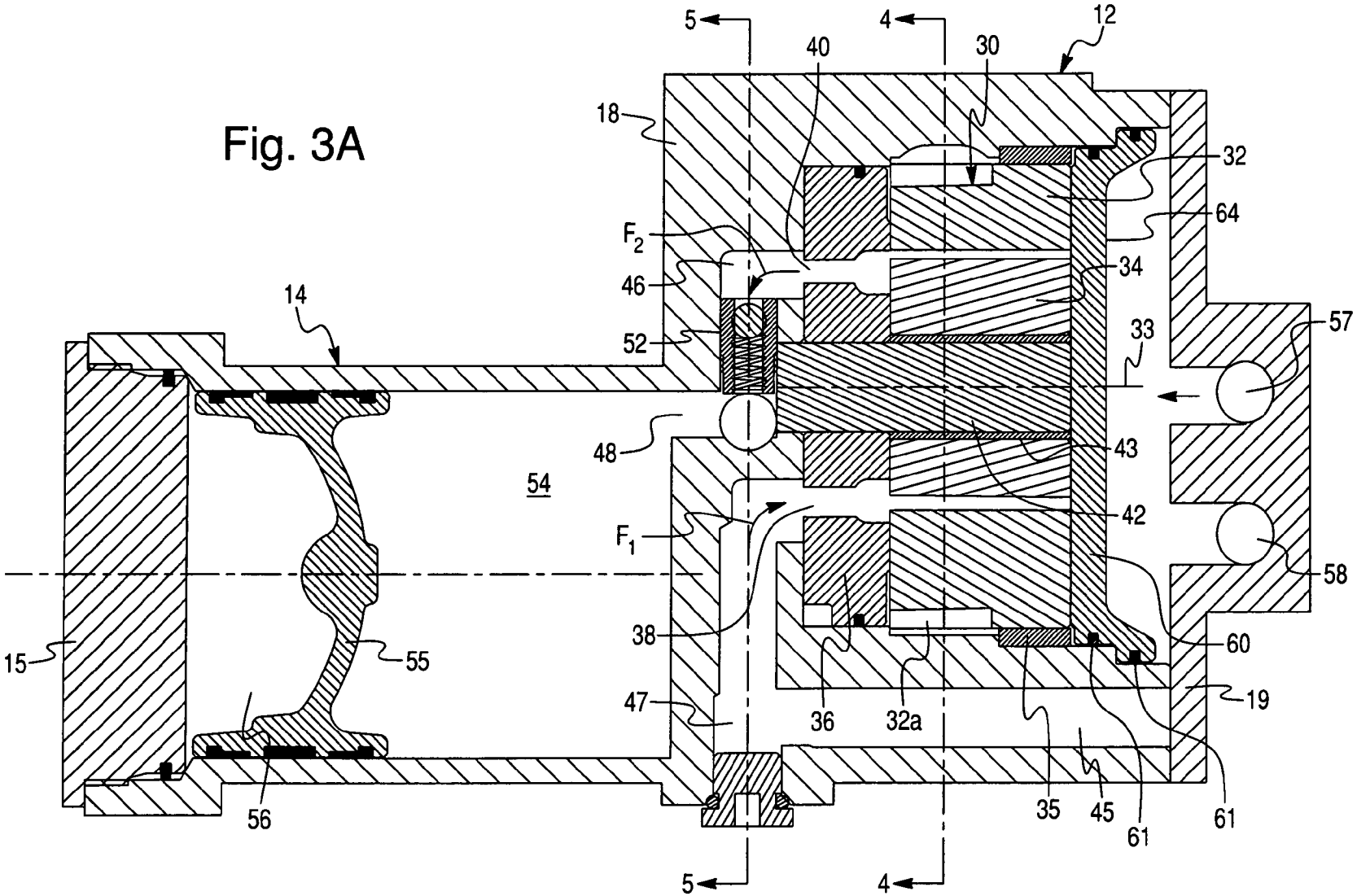
FIG. 3A is a sectional view of the fluid pump assembly according to the preferred embodiment of the present invention showing an end plate in a first position.
Figure 3B:
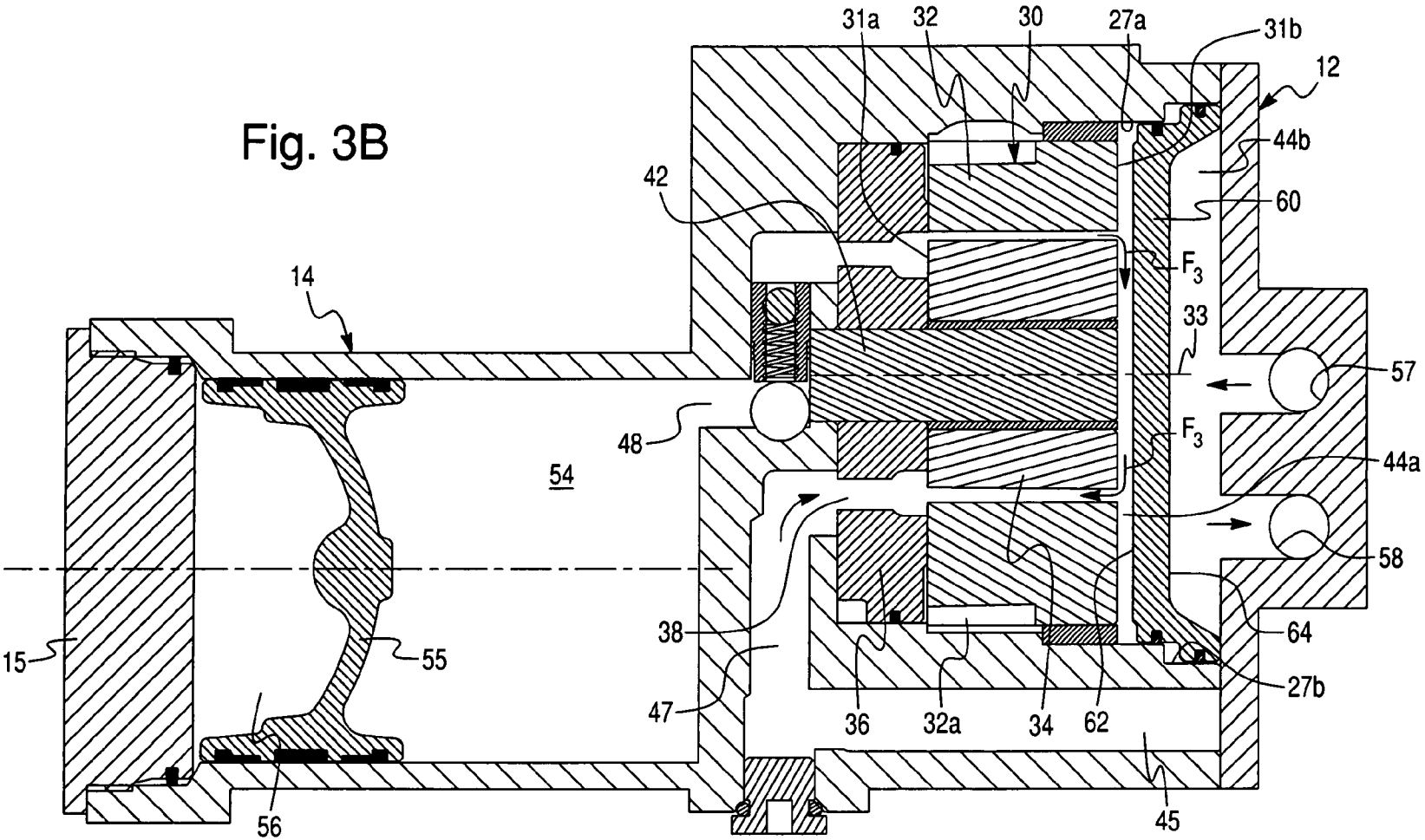
FIG. 3B is a sectional view of the fluid pump assembly according to the preferred embodiment of the present invention showing the end plate in a second position.

FIGS. 1 and 2 depict a limited slip differential-type torque-coupling assembly 10 that includes a hydraulically actuated torque-distribution device 11 in the form of a limited-slip differential disposed in a torque coupling housing 16, and a combined fluid pump assembly 12 and hydraulic accumulator 14, shown in detail in FIGS. 3A and 3B. It will be appreciated that the current invention may also be used with any other fluid actuated torque coupling known in the art. Preferably, the fluid pump assembly 12 is in the form of a gerotor pump assembly. Alternative pump types may be used. For example, the fluid pump assembly 12 may be a gear pump, a crescent pump, or a vane pump. The gerotor pump assembly 12 and the hydraulic accumulator 14 develop hydraulic pressure that is used to actuate the torque-coupling assembly 10. The limited-slip differential 11 of the current invention is well known in the art and includes a multi-disk friction clutch 24 that is hydraulically actuated by a variable pressure piston assembly 25 shown in FIG. 7. More specifically, the hydraulic pressure generated by the gerotor pump assembly 12 and/or stored in the accumulator 14 is used to selectively actuate the friction clutch 24. The friction clutch 24 is disposed within a torque coupling case 17 (shown in FIG. 2) rotatably supported within the torque coupling housing 16.

As best shown in FIG. 1, the gerotor pump assembly 12 and accumulator 14 are mounted outside of the torque coupling housing 16 in a common modular-type pump housing 18. The torque-coupling assembly 10 receives an input torque through an input gear shaft 20. The input torque is communicated to the gerotor pump 12 through a gearing assembly housed in an intermediate portion 22 of the torque-coupling housing 16. The limited-slip differential 11 of the torque-coupling assembly 10 selectively allocates the input torque between first 21 and second 23 output shafts extending from opposite sides of the torque-coupling assembly 10.

FIGS. 3A and 3B show a sectional view of the fluid pump assembly 12 and the accumulator 14 both disposed in the common modular-type pump housing 18. As further illustrated in FIGS. 3A-3C, the fluid pump assembly 12 comprises a fluid pump 30, a stationary port plate 36 abutting one end of the gerotor pump 30, and an end plate 60 disposed adjacent to the other end of the gerotor pump 30, all disposed within the pump housing 18 closed with a cover member 19.

Figure 3C:
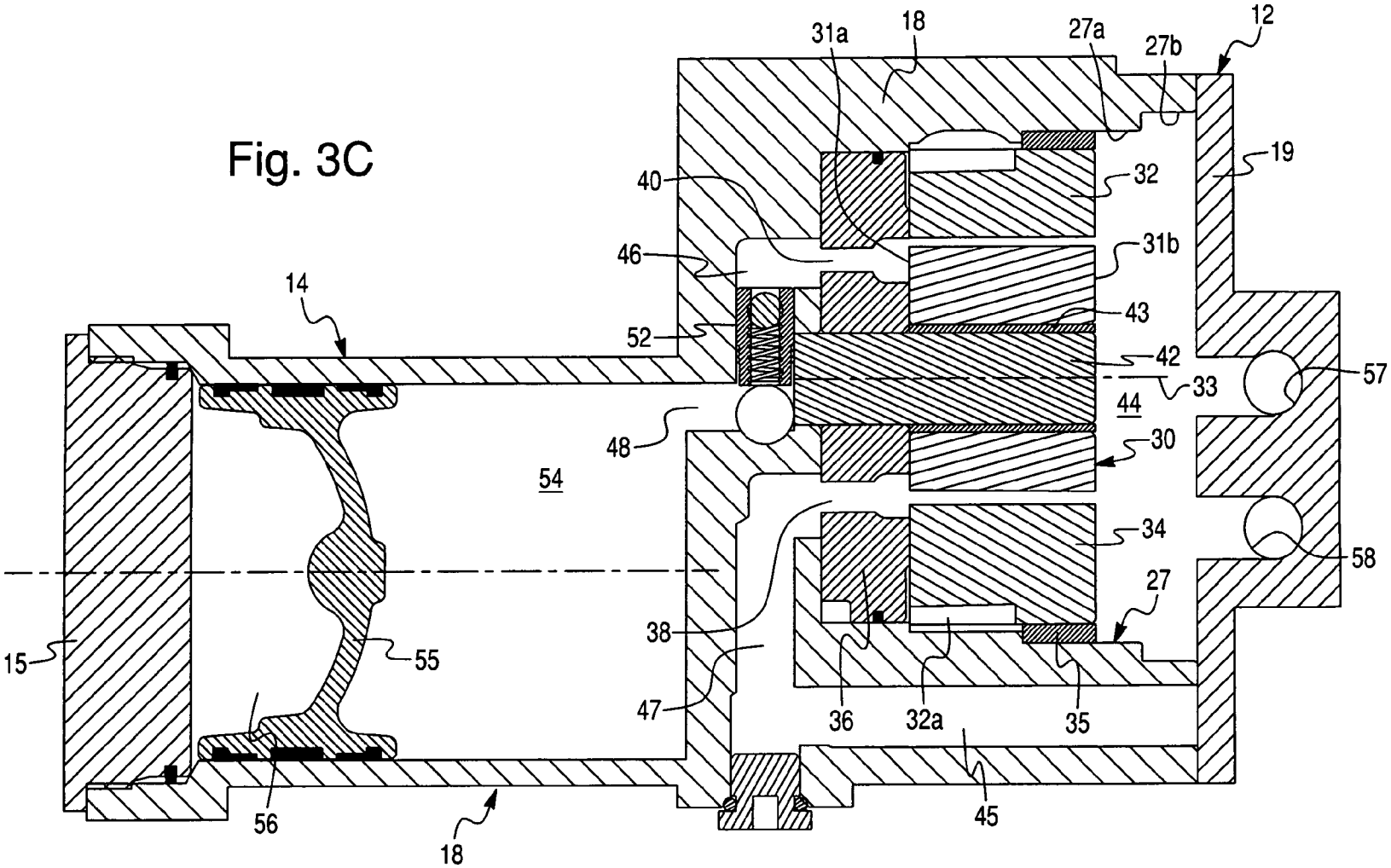
FIG. 3C is a sectional view of the fluid pump assembly according to the preferred embodiment of the present invention without the end plate.
Figure 4:
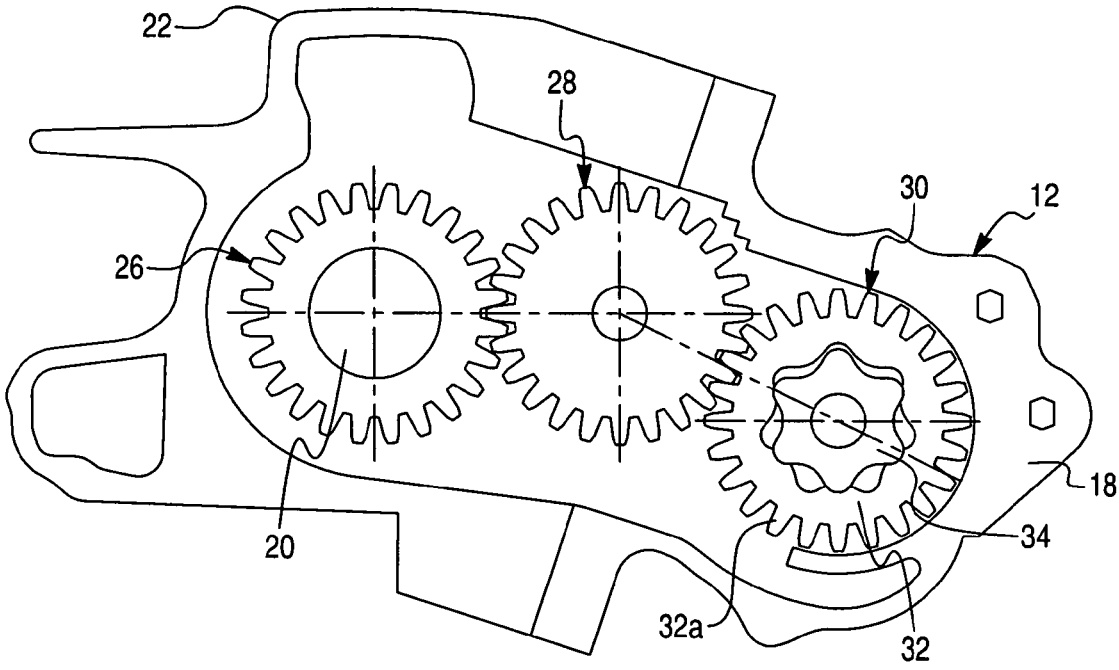
FIG. 4 is a sectional view taken along the line 4-4 shown in FIG. 3A.

The gerotor pump 30 includes an internally toothed impeller member 32 and externally toothed rotor member 34 cooperating with the impeller member 32 and disposed substantially therewithin for rotation about a central axis 33. The impeller member 32 is rotatably supported within the pump housing 18 through a bearing sleeve 35. The rotor member 34 is rotatably supported within the pump housing 18 by a gerotor support shaft 42 through a bearing sleeve 43. As illustrated in FIG. 3C, the fluid pump 30 has a first side face 31*a* and a second side face 31*b* substantially parallel to each other and oriented axially opposite in the direction of the central axis 33. As best shown in FIGS. 2 and 4, the input shaft 20 drives an associated pinion-type gear head 26 that, in turn, drives an intermediate gear 28. The intermediate gear 28 meshes with teeth 32*a* provided on an outer peripheral surface of the impeller member 32 of the gerotor pump 30. Thus, the input shaft 20 drives the gerotor pump 12. As best shown in FIG. 4, the gear head 26 and a portion of the intermediate gear 28 are housed in the intermediate portion 22 of the torque coupling housing 16, and the gerotor pump assembly 12 is disposed in the separate housing 18.

The port plate 36 abuts the first side face 31*a* of the gerotor pump 30 and includes an inlet port 38 through which fluid is drawn into the gerotor pump 30, and an outlet port 40 through which pressurized fluid is ejected from the gerotor pump 30. In the other words, the inlet and outlet ports 38 and 40, respectively, are disposed adjacent to the first side face of the fluid pump 30. Each of the inlet and outlet ports 38 and 40, respectively, includes one or more apertures, as shown in FIG. 2. Preferably, the port plate 36 is considered "reversible" because when the direction of rotation of the input gear shaft 20 is reversed, the port plate 36 rotates 180° to maintain the proper alignment between the port plate 36 and the internal components of the gerotor pump 30. Moreover, the pump housing 18 includes a fluid reservoir 45 formed therein. The hydraulic fluid from the fluid reservoir 45 is drawn into the gerotor pump 30 through inlet the inlet port 38 in the port plate 36. The pressurized hydraulic fluid exits the pump 30 through the outlet port 40 in the port plate 36 and is directed into a connecting passage 50.

As further shown in FIG. 3C, a pressure chamber 44 is formed within the pump housing 18 adjacent to the second side face 31*b* of the pump 30. The pressure chamber 44 houses the end plate 60 movable relative to the second side face 31*b* of the pump 30 between a first position (as illustrated in FIG. 3A) and a second position (as illustrated in FIG. 3B).

More specifically, in the first position, the end plate 60 is in sealable contact with the second side face 31*b* of the pump 30, while in the second position, the end plate 60 is axially spaced from the second side face 31*b* of the pump 30.

Figure 6A:
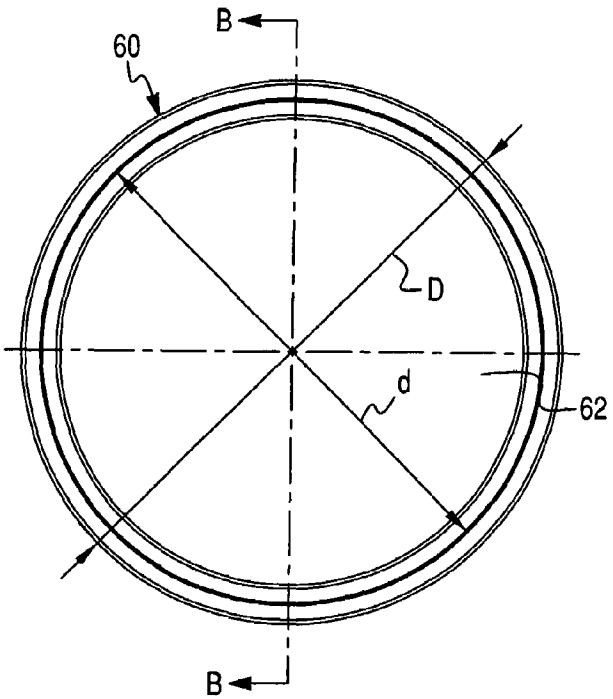
FIG. 6A is a front view of the end plate of the fluid pump assembly according to the preferred embodiment of the present invention.
Figure 6B:
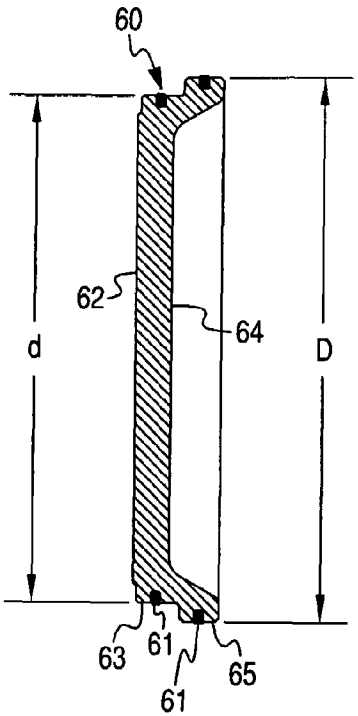
FIG. 6B is a sectional view of the end plate of the fluid pump assembly according to the preferred embodiment of the present invention showing the end plate in a second position.
Figure 6C:
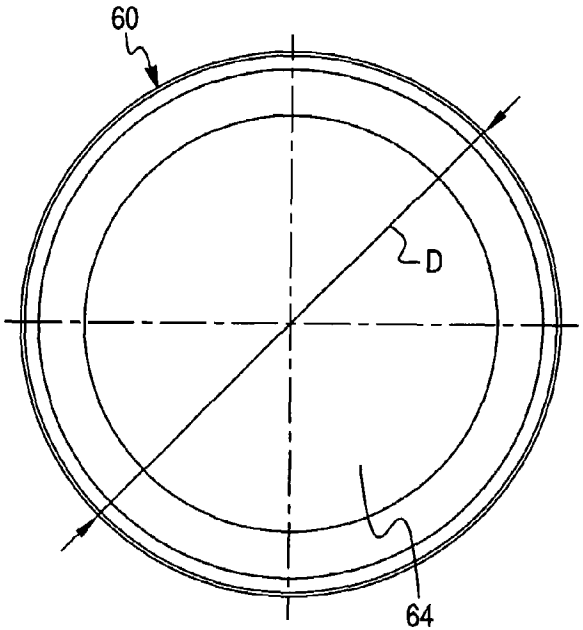
FIG. 6C is a rear view of the end plate of the fluid pump assembly according to the preferred embodiment of the present invention.

The end plate 60 has axially opposite inner and outer end surfaces 62 and 64, respectively, oriented so that the inner end surface 62 faces the second side face 31*b* of the fluid pump 30, while the outer end surface 64 faces away from the fluid pump 30. According to the present invention, the end plate 60 has a smaller end section 63 delimited by the inner end surface 62, and a larger end section 65 delimited by the outer end surface 64, so that an area of the outer end surface 64 of the end plate 60 is greater than the area of the inner end surface 62 thereof. Preferably, the end plate 60 is in the form of a stepped piston, illustrated in detail in FIGS. 6A-6B, having a substantially cylindrical smaller diameter section 63 delimited by the inner end surface 62, and a substantially cylindrical larger diameter section 65 delimited by the outer end surface 64. Consequently, the smaller end section 62 has a smaller diameter d than a diameter D of the larger end section 64. Hence, an area of the outer end surface 64 of the end plate 60 is greater than the area of the inner end surface 62 thereof. Each of the smaller diameter section 63 and the larger diameter section 65 of the piston 60 is provided with at least one elastomeric sealing ring, such as an O-ring 61.

Referring back to FIG. 3C, the pressure chamber 44 within the pump housing 18 is defined by a stepped bore 27 including a smaller bore 27*a* slidably receiving the smaller diameter section 63 of the piston 60, and a larger bore 27*b* slidably receiving the larger diameter section 65 thereof. Furthermore, as shown in detail in FIG. 3B, the piston 60 sealingly divides the pressure chamber 44 to a bypass cavity 44*a* adjacent to the inner end surface 62 of the piston 60, and an operating cavity adjacent to the outer end surface 64 of the piston 60. In other words, the bypass cavity 44*a* is formed adjacent to the second side face 31*b* of the pump 30 and defined between the pump 30 and the piston 60.

Figure 5:
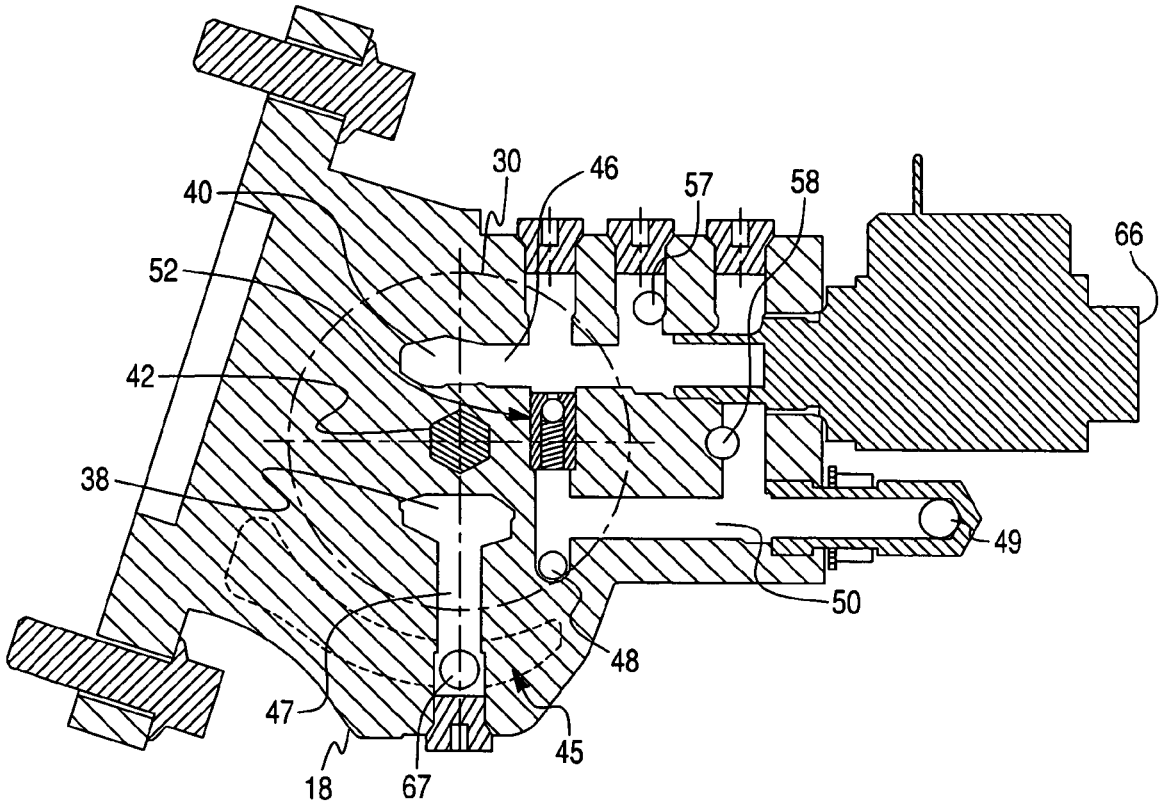
FIG. 5 is a sectional view taken along the line 5-5 shown in FIG. 3A.

As best shown in FIGS. 3A, 3B and 5, the fluid in the connecting passage 46 is directed through an inline check valve 52. The check valve 52 ensures that hydraulic fluid only flows away from the gerotor pump 30 as is not allowed to flow in a reverse direction. In the preferred embodiment, the check valve 52 is spring-driven so that a pre-determined amount of hydraulic pressure must be generated by the gerotor pump 30 to allow fluid to flow through the connecting passage 46.

The connecting passage 46 fluidly connects the outlet port 40 of the gerotor pump 30 with an accumulator reservoir 54 through an accumulator inlet/outlet aperture 48. In the preferred embodiment of the present invention, the accumulator 14 has a generally cylindrical shape and extends substantially parallel to the central axis 33 of the gerotor support shaft 42. However, in alternate embodiments, the accumulator 14 may be of any form known in the art and may be oriented and configured as required for a specific application. As best shown in FIG. 3A, the accumulator 14 includes a piston 55 that is driven by a force-producing means 56. In the preferred embodiment, the force-producing means 56 is comprised of a gas charge, however, the force-producing means 56 may be comprised of any means known in the art, including a spring or other resilient member. When the force-producing means 56 is compressed (as shown in FIG. 4), the piston 55 applies a pressure to the hydraulic fluid within the accumulator reservoir 54. A removable accumulator cap 15 is positioned opposite the inlet/outlet aperture 48 and allows the force-producing means 56 to be easily adjusted to vary the pressure exerted on the fluid in the hydraulic reservoir 54.

Moreover, the connecting passage 46 fluidly connects the outlet port 40 of the gerotor pump 30 with the operating cavity 44*b* of the pressure chamber 44 of the fluid pump assembly 12. More specifically, the pressure chamber 44 of the pressure chamber 44 is provided with an inlet orifice 57 and an outlet orifice 58. As best shown in FIG. 5, the connecting passage 46 fluidly connects the outlet port 40 of the gerotor pump 30 with the inlet orifice 57, thus fluidly connecting the operating cavity 44*b* of the pressure chamber 44 with the outlet port 40 of the pump assembly 12.

A portion of the fluid in the connecting passage 46 is then directed past the accumulator inlet/outlet aperture 48 to a communication passage 50 (best shown in FIG. 5).

Figure 7:
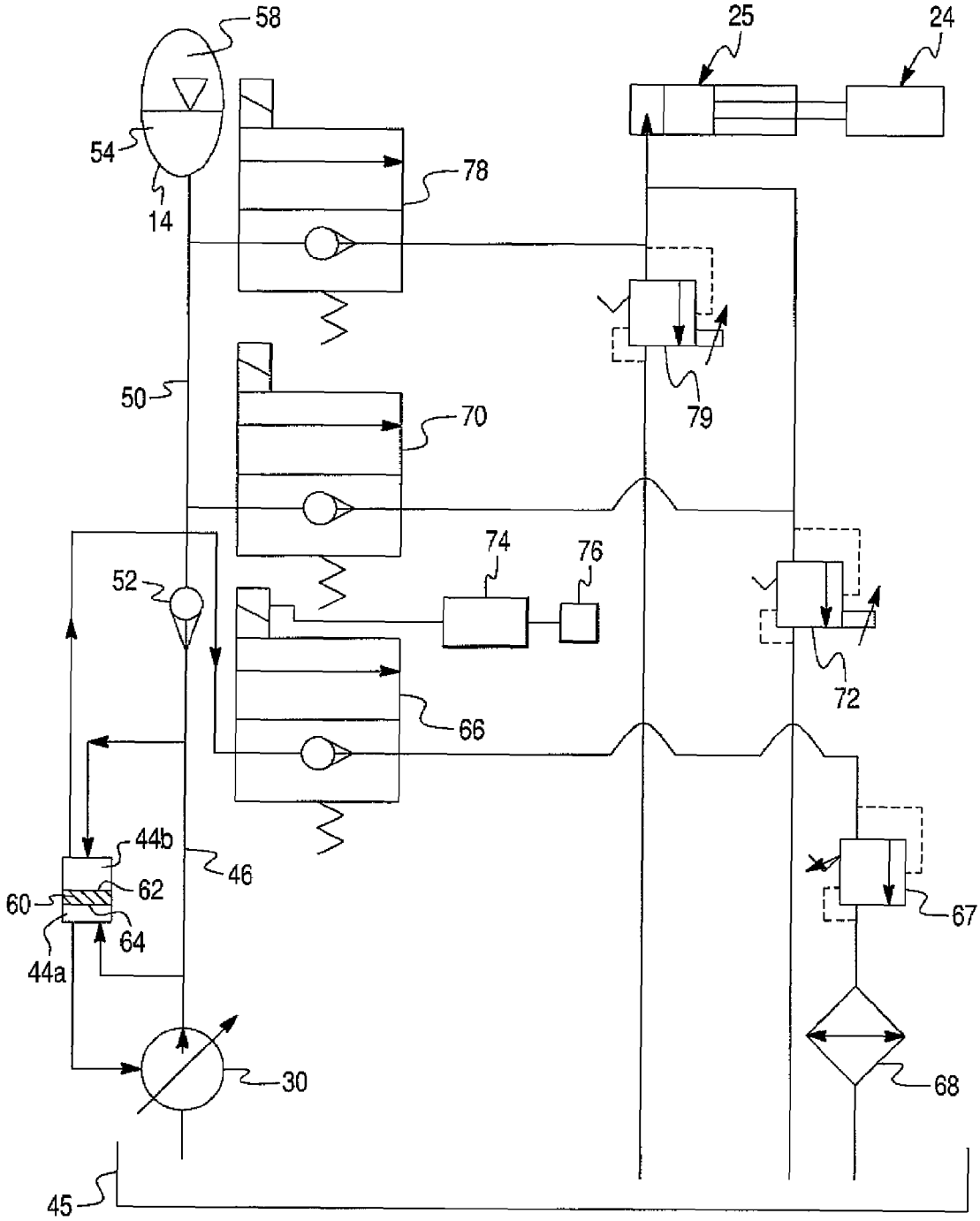
FIG. 7 is a schematic view of a hydraulic circuit according to the preferred embodiment of the present invention.

The communication passage 50 connects the gerotor pump 30 and the operating cavity 44*b* of the pressure chamber 44 with the remainder of the fluid pump assembly 12 schematically shown in FIG. 7 through an outlet aperture 49. The operating cavity 44*b* is fluidly connected to the communication passage 50 through the outlet orifice 58.

FIG. 7 depicts a hydraulic circuit of the present invention. As illustrated, the pump 30 is fluidly connected to the accumulator 14 via the check valve 52. At least a portion of the fluid generated by the pump 30 is directed through the check valve 52 and into the accumulator reservoir 54. As the volume of fluid in the reservoir 54 expands, the gas charge 58 is compressed by the piston 56 of the accumulator reservoir 54. The hydraulic accumulator 14 is also in fluid communication with the remainder of the hydraulic system including the pressure piston assembly 25 through the communication passage 50, the outlet aperture 49 (shown in FIG. 5), a selectively actuated solenoid valve 78 and a reducer valve 79, as shown in FIG. 7. In turn, the pressure piston assembly 25 actuates the friction clutch 24 if necessary to restrict the speed differential between the between first 21 and second 23 output shafts of the torque coupling assembly 10.

When the gerotor pump 30 is turned off, the compressed gas charge 58 applies a force to the fluid in the accumulator reservoir 54. As best shown in FIGS. 5 and 7, hydraulic pressure from the accumulator reservoir 54 is communicated through the accumulator inlet/outlet 48 to the communication passage 50. The hydraulic pressure in the accumulator 14 is then communicated from the communication passage 50 out the aperture 49 to the piston assembly 25 through the solenoid valve 78 and the reducer valve 79. In other words, the hydraulic pressure of the accumulator 14 is used to selectively actuate the friction clutch 24.

On the other hand, the friction clutch 24 can be actuated by the hydraulic pressure generated the gerotor pump 30 if the hydraulic pressure within the accumulator 14 is below a predetermined minimum pressure required to actuate the friction clutch 24. In this case, the hydraulic pressure generated by the gerotor pump 30 is communicated with the piston assembly 25 through a solenoid valve 70 and a reducer valve 72 to selectively actuate the friction clutch 24.

Therefore, the design of the present invention allows the vehicle hydraulic system to be pressurized by either the gerotor pump assembly 12 or the co-located accumulator 14.

Furthermore, the gerotor pump assembly 12 is selectively actuated and controlled by the piston 60 acting as the end plate to create a selectively adjustable seal between the inner end surface 62 of the piston 60 and the second side face 31*b* of the pump 30. The movement of the piston 60 is controlled by a selectively actuated, solenoid pump control valve 66 and a a reducer valve 67 which are best shown in FIG. 7. Thus, the present invention allows an operator to vary the pressure developed by the fluid pump assembly 12 and to selectively operate the fluid pump assembly 12 between activated and deactivated modes.

In operation, as best shown in FIGS. 3A-3C and 5, hydraulic fluid from the hydraulic gerotor reservoir 45 is drawn into the gerotor pump 30 from a reservoir opening 67 through a supply passage 47 into the inlet port 38 in the port plate 36, as illustrated by arrow $F_1$. The fluid passes through the gerotor pump 30 which generates the pressurized hydraulic fluid flow. The pressurized hydraulic fluid exits the first side face 31*a* of the pump 30 through the outlet port 40 in the port plate 36 under pressure into the connecting passage 46, as illustrated by arrow $F_2$. At least a portion of the pressurized hydraulic fluid exits the second side face 31*b* of the pump 30 into the bypass cavity 44*a* and acts upon the inner end surface 62 of the piston 60 to the pressure generated by the pump 30.

In order to activate the pump assembly 12 (when pressure is required from the pump assembly 12), an electronic control unit (ECU) 74 (shown in FIG. 7) closes the solenoid pump valve 66. Consequently, as the outlet port 40 of the pump assembly 12 is fluidly connected to the operating cavity 44*b* of the pressure chamber 44, the hydraulic pressure builds up in the operating cavity 44*b*, thus subjecting the outer end surface 64 of the piston 60 to the same hydraulic pressure generated by the pump 30 as the inner end surface 62 of the piston 60. It will be appreciated that as the area of the outer end surface 64 of the piston 60 is larger than the area of the inner end surface 62 thereof, the resulting force acting on both end surfaces 62, 64 of piston 60 acts in a direction toward the first position of the piston 60. In this first position, the inner end surface 62 of the piston 60 is in sealable contact with (or abuts) the second side face 31*b* of the pump 30. In other words, in the first position, the piston 60 forms a seal with the pump, confining the fluid outlet to create pressure. The restricted fluid flow generates a rapid pressure increase within the pump assembly 12, thus activating the pump assembly 12.

The above control of the solenoid pump valve 66 is carried out by judging vehicle running conditions according to at least one vehicle operating parameter, and/or at least one operating parameter of the torque-coupling assembly 10 inputted into the ECU 74 from one or more vehicle and/or torque-coupling operating parameter sensors generally depicted by the reference numeral 76 (shown in FIG. 7). The at least one vehicle parameter includes but is not limited to a vehicle acceleration and a vehicle brake pedal, while the at least one operating parameter of the torque-coupling assembly 10 includes but is not limited to a hydraulic pressure within accumulator 14.

In order to deactivate the pump assembly 12 (when no pressure is required from the pump assembly 12, such as when the accumulator 14 is fully charged), the ECU 74 opens the solenoid pump valve 66 and the proportional valve 67. Consequently, the pressure is released from the operating cavity 44*b*, thus subjecting only the inner end surface 62 of the piston 60 to the hydraulic pressure generated by the pump 30. The excess of pressurized hydraulic fluid generated by the pump 12 is returned to the sump 45 through the solenoid pump control valve 66, the reducer valve 67 and a fluid cooler 68, as shown in FIG. 7. As a result, the piston 60 moves (or is pushed) to its second position where the piston 60 is positioned away (axially spaced) from the second sides face 31*b* of the pump 30, as shown in FIG. 3B. This configuration allows fluid to enter the inlet port 38, circulate through the pump 30, and exit the second side face 31*b* of the pump 30 and immediately re-enter the pump 30, as illustrated by arrows $F_3$, thus preventing the pump 30 from building pressure. In this second position of the piston 60, no pressure is generated within the pump 30. In other words, the pump assembly 12 is deactivated, and the input power required to drive the pump assembly 12 is very small.

Therefore, the solenoid pump valve 66 is capable of selectively operating the fluid pump assembly 12 between activated and deactivated modes. The movement of the piston 60 between the first and second positions illustrates the reciprocal nature of the piston 60.

It will be appreciated that while the present invention is described in relation to the torque coupling assembly for the motor vehicle, the invention is not limited to the illustrated and described features and any piston-controlled variable pressure, selectively operable fluid pump assembly is within the scope of the present invention.

From the foregoing description it is clear that the current invention describes a novel selectively operable fluid pump assembly providing a variable pressure fluid for a pressurized fluid system and capable of selectively deactivating the pump assembly and operated with greatly increased efficiency.

The foregoing description of the preferred embodiment of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A fluid pump assembly comprising:

a pump housing and a fluid pump disposed within said pump housing;

said fluid pump including an impeller member and a rotor member cooperating with said impeller member and disposed substantially therewithin for rotation about a central axis, said fluid pump having axially opposite first and second side faces;

inlet and outlet ports disposed adjacent to said first side face of said fluid pump;

a pressure chamber formed within said pump housing adjacent to said second side face of said pump; and an end plate disposed within said pressure chamber and movable relative to said pump between a first position and a second position;

said end plate having axially opposite inner and outer end surfaces oriented so that said inner end surface facing said fluid pump and said outer end surface facing away from said fluid pump;

an area of said outer end surface of said end plate being greater than the area of said inner end surface thereof;

said end plate being in the form of a stepped piston having a smaller diameter section delimited by said inner end surface, and a larger diameter section delimited by said outer end surface;

said pressure chamber within said pump housing being defined by a stepped bore including a smaller diameter bore slidably receiving the smaller diameter section of said piston, and a larger bore slidably receiving the larger diameter section thereof.

2. The fluid pump assembly as defined in claim 1, wherein said end plate is in sealable contact with said second side face of said pump in said first position, and is axially spaced from said second side face of said pump in said second position.

3. The fluid pump assembly as defined in claim 1, wherein said end plate has a smaller end section delimited by said inner end surface, and a larger end section delimited by said outer end surface.

4. The fluid pump assembly as defined in claim 1, wherein said end plate divides said pressure chamber to a bypass cavity adjacent to said fluid pump and an operating cavity fluidly connected to said outlet port of said fluid pump assembly.

5. The fluid pump assembly as defined in claim 4, further comprising a fluid reservoir fluidly connected to said inlet port;

wherein said operating cavity is selectively fluidly connected to said fluid reservoir.

6. The fluid pump assembly as defined in claim 5, wherein said fluid reservoir is formed within said pump housing.

7. The fluid pump assembly as defined in claim 5, wherein said end plate moves to said first position when said operating cavity is fluidly disconnected from said fluid reservoir to build a fluid pressure in said operating cavity, and wherein said end plate moves to said second position when said operating cavity is fluidly connected to said fluid reservoir to release the fluid pressure in said operating cavity.

8. The fluid pump assembly as defined in claim 5, further comprising a pump control valve selectively fluidly connecting said operating cavity to said fluid reservoir.

9. The fluid pump assembly as defined in claim 8, wherein said pump control valve includes a solenoid valve selectively controlled by an electronic control unit.

10. The fluid pump assembly as defined in claim 9, wherein said electronic control unit controls said solenoid valve based on a signal from at least one sensor monitoring at least one operating parameter of an apparatus employing said fluid pump assembly.

11. The fluid pump assembly as defined in claim 10, wherein said apparatus employing said fluid pump assembly is a hydraulically actuated torque-coupling assembly in a motor vehicle.

12. The fluid pump assembly as defined in claim 1, further comprising a port plate disposed in said pump housing adjacent to said first side face of said fluid pump;

wherein said inlet and outlet ports are formed in said port plate.

13. The fluid pump assembly as defined in claim 12, wherein said port plate is reversible.

14. The fluid pump assembly as defined in claim 1, wherein said fluid pump is a gerotor pump.

15. The fluid pump assembly as defined in claim 1, wherein said fluid pump is driven by an input gear drivingly coupled to said impeller member.

16. The fluid pump assembly as defined in claim 15, wherein said impeller member includes a plurality of gear teeth provided on an outer peripheral surface thereof in mesh with complementary gear teeth of said input gear.

* * * * *